US011849838B1

(12) United States Patent
Yang

(10) Patent No.: US 11,849,838 B1
(45) Date of Patent: Dec. 26, 2023

(54) DETACHABLE TABLE BOARD SUPPORTING BASE AND SPLICING TABLE THEREOF

(71) Applicant: Xuanbin Yang, Nanjing (CN)

(72) Inventor: Xuanbin Yang, Nanjing (CN)

( * ) Notice: Subject to any disclaimer, the term of this patent is extended or adjusted under 35 U.S.C. 154(b) by 0 days.

(21) Appl. No.: 17/897,607

(22) Filed: Aug. 29, 2022

(30) Foreign Application Priority Data

Jul. 1, 2022 (CN) ..... 202221696091

(51) Int. Cl.
*A47B 3/06* (2006.01)

(52) U.S. Cl.
CPC ..... *A47B 3/06* (2013.01)

(58) Field of Classification Search
CPC ..... A47B 3/06; A47B 13/02
See application file for complete search history.

(56) References Cited

U.S. PATENT DOCUMENTS 7,296,522 B1 * 11/2007 Mahmalji ..... A47B 37/04 108/50.13
8,418,633 B1 * 4/2013 Lee ..... A47B 13/003 108/157.15
2003/0010261 A1 * 1/2003 Liu ..... A47B 13/06 108/153.1
2006/0196396 A1 * 9/2006 Rivera ..... A47B 3/06 108/157.1
2008/0083858 A1 * 4/2008 Goodman ..... A47B 13/02 248/188.8
2016/0296004 A1 * 10/2016 Peng ..... A47B 3/002
2021/0219711 A1 * 7/2021 Lai ..... A47B 13/003

FOREIGN PATENT DOCUMENTS

CN 113508986 A * 10/2021

OTHER PUBLICATIONS

English translation of CN 113508986A from espacenet (Year: 2023).*

* cited by examiner

*Primary Examiner* — Daniel J Rohrhoff
(74) *Attorney, Agent, or Firm* — Chun-Ming Shih; LANWAY IPR SERVICES

(57) ABSTRACT

The present patent provides a detachable table board supporting base and a splicing table thereof, which relates to the technical field of tables, so as to solve the problems in the prior art that it is not easy to package and transport the tables and it is easy to damage the tables in the transferring or transportation process. The table board supporting base comprises a base body and a base reinforcing mechanism, the base body comprises supporting legs provided at the bottom of the table board, the table board is detachably connected above the supporting legs, and the supporting legs are used to support the table board; the base reinforcing mechanism comprises a reinforcing base body, a supporting leg connecting part and a table board connecting part, and the table board connecting part is detachably connected between the reinforcing base body and the table board.

9 Claims, 7 Drawing Sheets

DETACHABLE TABLE BOARD SUPPORTING BASE AND SPLICING TABLE THEREOF

TECHNICAL FIELD

The present patent relates to the technical field of tables, in particular to a detachable table board supporting base and a splicing table thereof.

BACKGROUND ART

A table is a piece of common furniture, which is mostly made of wood. There is a plane at the top and a pillar at the bottom. People can put things, do things, eat, write, work, etc. on the table. The table is a piece of furniture that is fixed by smooth flat plates, legs and other supports.

In order to cater to the current trend of e-commerce, products sold online need to be delivered to customers by logistics, so that the transportation cost of products will increase. Facilitating packaging and transportation and reducing the cost of packaging and transportation will bring higher benefits to companies and manufacturers.

Although the existing tables are quite different in shape, style and materials, the tables are all similar in structure, mainly including a table top and table legs. The table legs are mounted on the lower surface of the table top. Most of the table legs are not detachable from the table top. The four table legs are integrated with the whole table top, which can be used as a whole.

The applicant found that the existing table has at least the following technical problems.

The area of the table top and the volume of the table legs determine the volume occupied in the transportation process. The table with the above structure cannot be disassembled, so that the product packaging volume is too large, the factory cost is high, it is not easy to package and transport, it is not conducive to the distribution of the occupied space during transportation, and it is easy to damage the table in the transferring or transportation process due to its too large volume.

SUMMARY

In view of this, the present patent aims to provide a detachable table board supporting base and a splicing table thereof, so as to solve the technical problems in the prior art that that it is not easy to package and transport the tables and it is easy to damage the tables in the transferring or transportation process.

In order to achieve the above purpose, the present patent provides a detachable table board supporting base, comprising a base body and a base reinforcing mechanism, wherein the base body is detachably provided below the table board, wherein: the base body comprises supporting legs provided at the bottom of the table board, the table board is detachably connected above the supporting legs, and the supporting legs are used to support the table board; the base reinforcing mechanism comprises a reinforcing base body, a supporting leg connecting part and a table board connecting part, one end of the supporting leg connecting part is detachably connected with the reinforcing base body, the other end of the supporting leg connecting part is fixedly connected with the corresponding supporting leg, and the table board connecting part is detachably connected between the reinforcing base body and the table board.

As a further improvement of the present patent, there are four supporting legs which are provided at the bottom of the table board in a square matrix, the bottom surface of the table board is provided with fixing parts, the number of the fixing parts is the same as that of the supporting legs, the positions of the fixing parts correspond to the positions of the supporting legs, and the tops of the supporting legs are capable of being locked to the corresponding fixing parts by a first locking member.

As a further improvement of the present patent, the supporting legs comprise a supporting leg body and a connector, the connector is fixed to the top of the supporting leg body, the supporting leg connecting part is fixedly connected with the supporting leg body, the connector is provided with at least two first through holes, the fixing part is provided with a second through hole corresponding to the first through hole, and the supporting legs pass through the first through hole and the second through hole through the first locking member to be detachably connected with the table board.

As a further improvement of the present patent, the supporting leg body has an arc structure, and the reinforcing base body has an annular structure.

As a further improvement of the present patent, the supporting leg connecting part comprises a connecting rod and a base body mounting part, one end of the connecting rod is fixedly connected with the supporting leg body, the end of the connecting rod far away from the supporting leg body is fixedly provided with the base body mounting part, the supporting leg connecting part is mounted on the reinforcing base body by the base body mounting part, and the base body mounting part is detachably connected with the reinforcing base body by a second locking member.

As a further improvement of the present patent, the whole base body mounting part is U-shaped, and comprises a connecting plate and two clamping plates, the connecting rod is fixedly connected with one side of the connecting plate, the two clamping plates are provided on the other side of the connecting plate at relative intervals, a clamping position for clamping the reinforcing base body is formed between the two clamping plates, and the two clamping plates are capable of being clamped at the upper edge and the lower edge of the reinforcing base body, and the connecting plate is fixedly connected with the reinforcing base body placed on the clamping position by the second locking member.

As a further improvement of the present patent, the table board connecting part comprises an arc-shaped support rod, both ends of the arc-shaped support rod are provided with a first connecting end and a second connecting end, respectively, the arc-shaped support rod is detachably connected with the table board by the first connecting end, the arc-shaped support rod is mounted on the reinforcing base body by the second connecting end, and the second connecting end is detachably connected with the reinforcing base body.

As a further improvement of the present patent, the reinforcing base body comprises two oppositely provided first reinforcing rods and two oppositely provided second reinforcing rods, the first ends of the two first reinforcing rods are connected by one of the second reinforcing rods, the second ends of the two first reinforcing rods are connected by the other second reinforcing rod, the fixed joints of the first reinforcing rods and the second reinforcing rods all transition through circular arcs, and the supporting leg connecting part is mounted at the circular-arc fixed joint of the first reinforcing rods and the second reinforcing rods by the corresponding base body installing part.

A splicing table is provided, comprising a table board and a table board supporting base, wherein the table board supporting base is the detachable table board supporting base described above, and the table board supporting base is capable of being detachably fixed to the bottom of the table board;

the table board comprises at least two splicing plate units, two adjacent splicing plate units are detachably connected, one surface of the splicing plate units forms the table top of the splicing table, the table board supporting base is detachably provided on the surface of the splicing plate units facing away from the table top, the table board connecting part is provided at the joint of the two splicing plate units, and the two splicing plate units are both detachably connected with the table board connecting part.

As a further improvement of the present patent, the table board comprises two splicing plate units, the two splicing plate units are capable of being abutted together in opposite directions, the side of one of the splicing plate units is provided with a first semicircular notch, the side of the other of the splicing plate units is correspondingly provided with a second semicircular notch which is capable of being spliced and matched with the first semicircular notch, the first semicircular notch is spliced and matched with the second semicircular notch to form a circular upper through hole, and the reinforcing base body is provided with a lower through hole corresponding to the upper through hole.

The detachable table board supporting base provided by the present patent provides a base reinforcing mechanism, which improves the overall strength of the table board supporting base, thus increasing the stability of the whole table. The base body comprises supporting legs provided at the bottom of the table board, the table board is detachably connected above the supporting legs, and the supporting legs are used to support the table board; the base reinforcing mechanism comprises a reinforcing base body, a supporting leg connecting part and a table board connecting part, one end of the supporting leg connecting part is detachably connected with the reinforcing base body, the other end of the supporting leg connecting part is fixedly connected with the corresponding supporting leg, and the table board connecting part is detachably connected between the reinforcing base body and the table board. Using the technical scheme described above, the table can be disassembled into transportable parts, which is convenient to transfer and transport the table. After the table is transported to the destination, the table board, the reinforcing base body, the supporting leg connecting part, the table board connecting part and four supporting legs are assembled into a table for use. The present patent can make the table have a smaller volume and a lighter transportation condition in the transportation process, and it is convenient to mount the table, thus reducing the packaging volume and preventing the table from being damaged in the transferring or transportation process.

BRIEF DESCRIPTION OF THE DRAWINGS

In order to explain the embodiments of the present patent or the technical scheme in the prior art more clearly, the drawings needed in the description of the embodiments or the prior art will be briefly introduced hereinafter. Obviously, the drawings in the following description are only some embodiments of the present patent. For those skilled in the art, other drawings can be obtained according to these drawings without paying creative labor.

Figure 1:
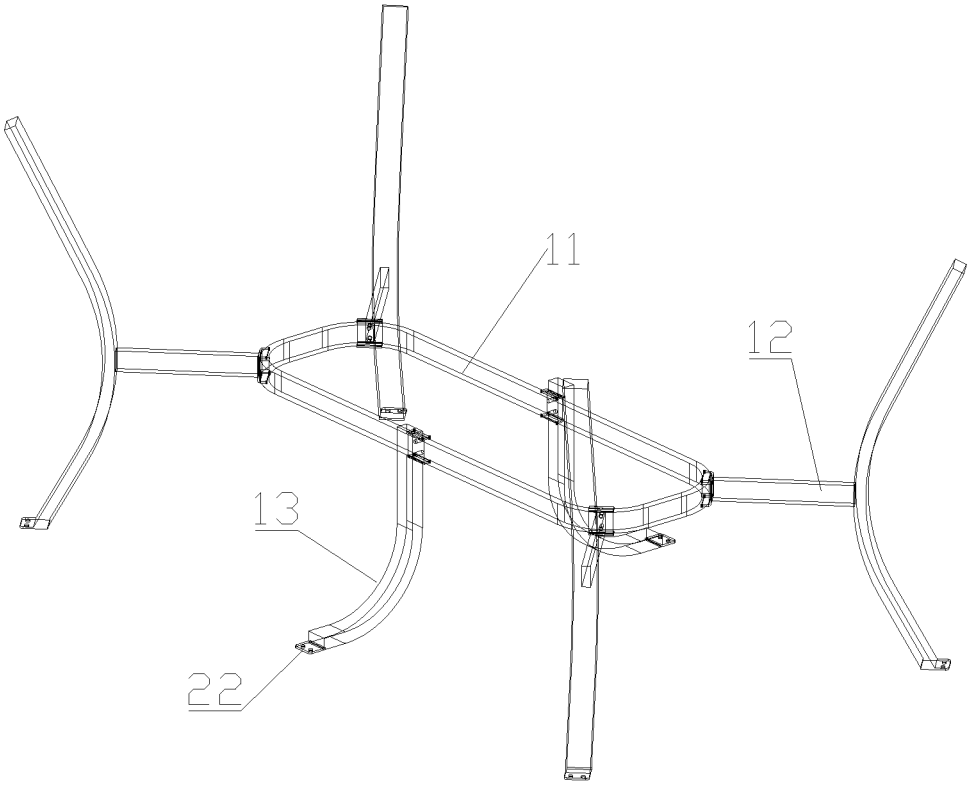
FIG. 1 is a structural schematic diagram of a table board supporting base according to the embodiment of the present patent.
Figure 2:
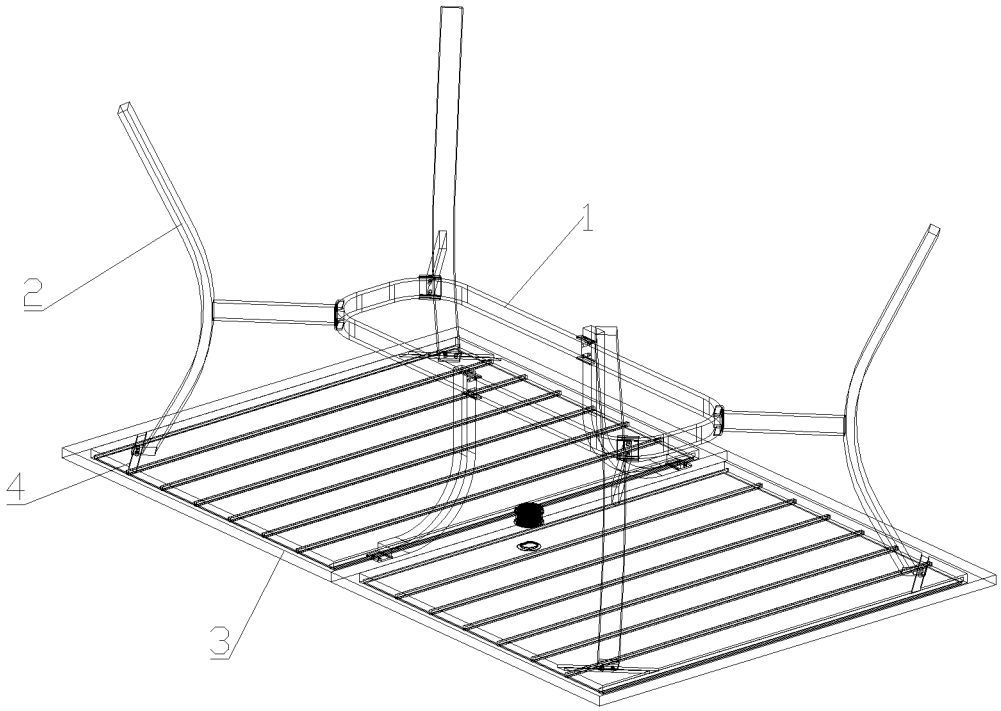
FIG. 2 is a schematic diagram of the overall structure of a splicing table according to the embodiment of the present patent.
Figure 3:
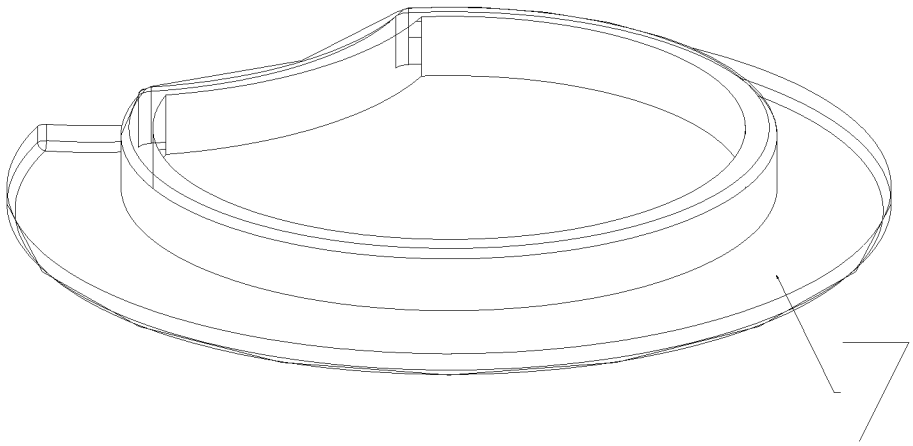
FIG. 3 is a structural schematic diagram of a plug according to the embodiment of the present patent.
Figure 4:
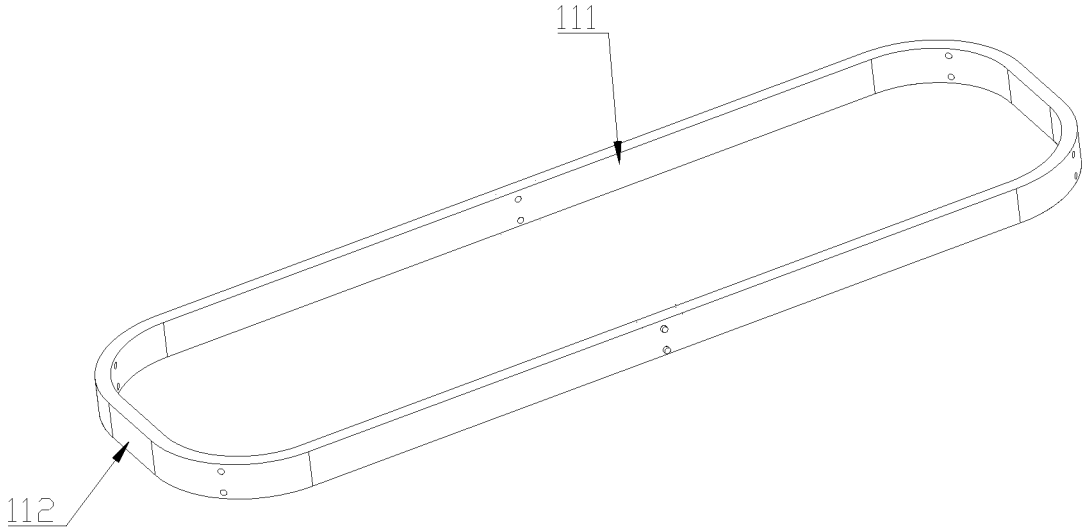
FIG. 4 is a structural schematic diagram of a reinforcing base body according to the embodiment of the present patent.

Reference numbers: 1. Base reinforcing mechanism; 11. Reinforcing base body; 111. First reinforcing rod; 112. Second reinforcing rod; 12. Supporting leg connecting part; 121. Connecting rod; 122. Base body mounting part; 1221. Connecting plate; 1222. Clamping plate; 13. Table board connecting part; 131. Arc-shaped support rod; 132. First connecting end; 133. Second connecting end; 1331. Vertical plate; 1332. Transverse plate; 2. Supporting leg; 21. Supporting leg body; 22. Connector; 221. First through hole; 3. Table board; 31. Splicing plate units; 4. Fixing part; 5. Second semicircular notch; 6. Upper through hole; 7. Plug.

DETAILED DESCRIPTION OF THE EMBODIMENTS

In order to make the purpose, technical scheme and advantages of the present patent clearer, the technical scheme of the present patent will be described in detail hereinafter. Obviously, the described embodiments are only some embodiments of the present patent, rather than all of the embodiments. Based on the embodiments in the present patent, all other embodiments obtained by those skilled in the art without paying creative labor belong to the scope of protection of the present patent.

In the description of the present patent, it should be noted that, unless otherwise stated, "a plurality of" means two or more. The orientational or positional relationships indicated by the terms "up", "down", "left", "right", "inside", "outside", "front", "back", "head" and "tail" are based on the orientational or positional relationships shown in the drawings, which is only to facilitate the description of the present patent and simplify the description, rather than indicate or imply that the referred device or element must have a specific orientation, be constructed and operated in a specific orientation. Therefore, it cannot be understood as a limitation to the present patent. In addition, the terms "first", "second" and "third" are only used for description purposes, but cannot be understood as indicating or implying relative importance.

In the description of the present patent, it should also be noted that unless otherwise stated and limited, the terms "mounting", "linking" and "connecting" should be understood broadly. For example, they can be fixed connection, detachable connection or integrated connection; they can be mechanical connection or electrical connection; they can be direct connection or indirect connection through an intermediate medium. For those skilled in the art, the specific meaning of the above terms in the present patent can be understood according to the specific situation.

As shown in FIGS. 1-10, the present patent provides a detachable table board 3 supporting base, which comprises a base body and a base reinforcing mechanism 1. The base body is detachably provided below the table board 3. The base reinforcing mechanism 1 is provided, which improves the strength of the table board 3 supporting base, thus increasing the stability of the whole table in use.

In this embodiment, the base body comprises supporting legs 2 provided at the bottom of the table board 3, the table board 3 is detachably connected above the supporting legs 2, and the supporting legs 2 are used to support the table board 3. The base reinforcing mechanism 1 comprises a reinforcing base body 11, a supporting leg connecting part 12 and a table board connecting part 13, one end of the supporting leg connecting part 12 is detachably connected with the reinforcing base body 11, the other end of the supporting leg connecting part 12 is fixedly connected with the corresponding supporting leg 2, and the table board connecting part 13 is detachably connected between the reinforcing base body 11 and the table board 3.

Using the technical scheme described above, the table can be disassembled into transportable parts, which is convenient to transfer and transport the table. After the table is transported to the destination, the table board 3, the reinforcing base body 11, the supporting leg connecting part 12, the table board connecting part 13 and four supporting legs 2 are assembled into a table for use.

In this embodiment, the table board 3 is rectangular in cross section. As an alternative embodiment of this embodiment, there are four supporting legs 2 which are provided at the bottom of the table board 3 in a square matrix. The top surface of the table board 3 forms a table top. The bottom surface of the table board 3 is provided with fixing parts 4. The number of the fixing parts 4 is the same as that of the supporting legs 2, and the positions of the fixing parts 4 correspond to the positions of the supporting legs 2. The tops of the supporting legs 2 are capable of being locked to the corresponding fixing parts 4 by a first locking member 8. That is to say, the supporting leg 2 is detachably connected with the fixing part 4 at the bottom of the table board 3 by the first locking member 8, which is convenient to disassemble and assemble and convenient to reduce the packaging volume when moving or transporting.

Figure 5:
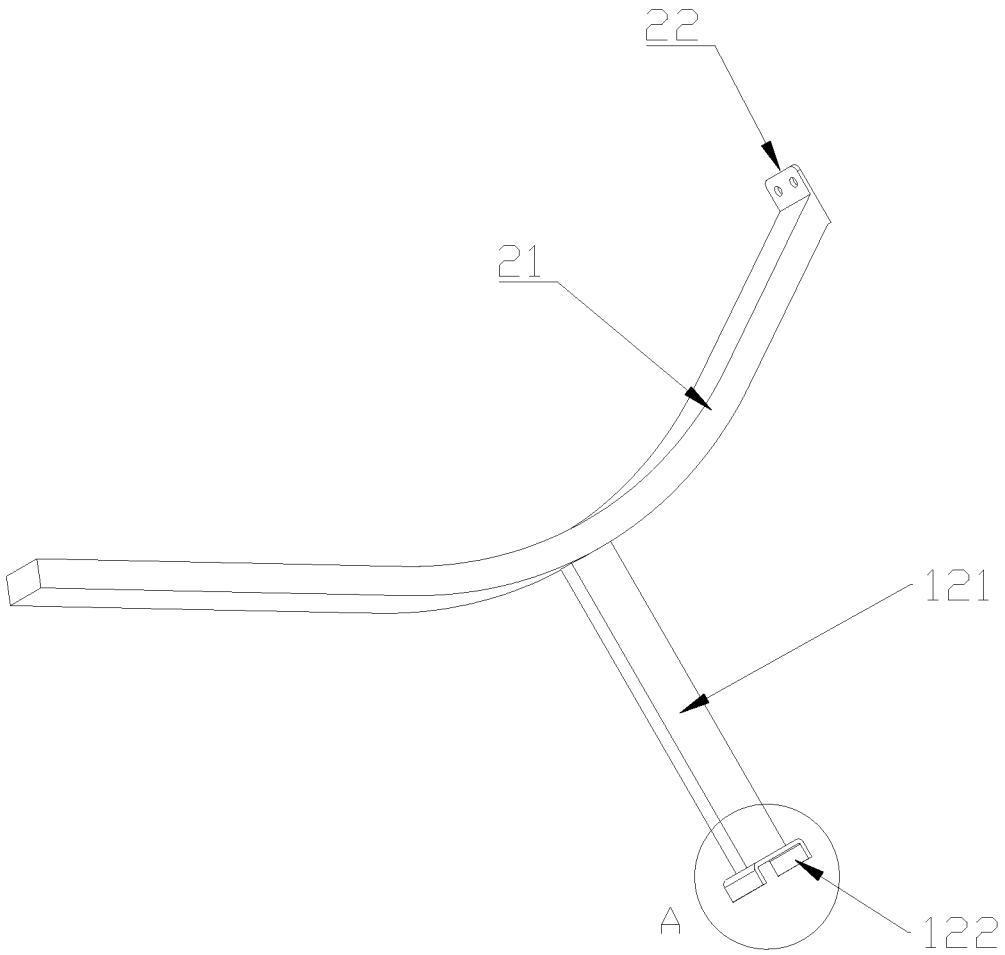
FIG. 5 is a schematic diagram of the cooperation between a supporting leg connecting part and a supporting leg according to the embodiment of the present patent.
Figure 6:
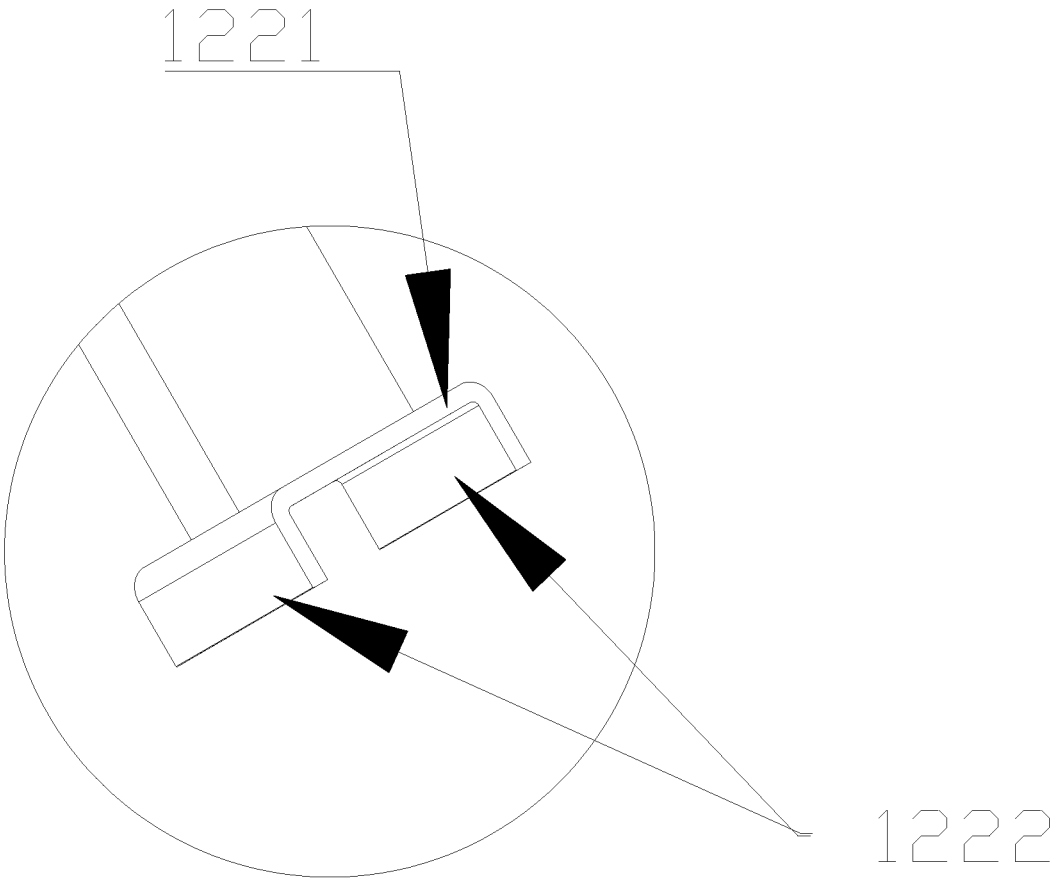
FIG. 6 is an enlarged view of part A in FIG. 5.
Figure 7:
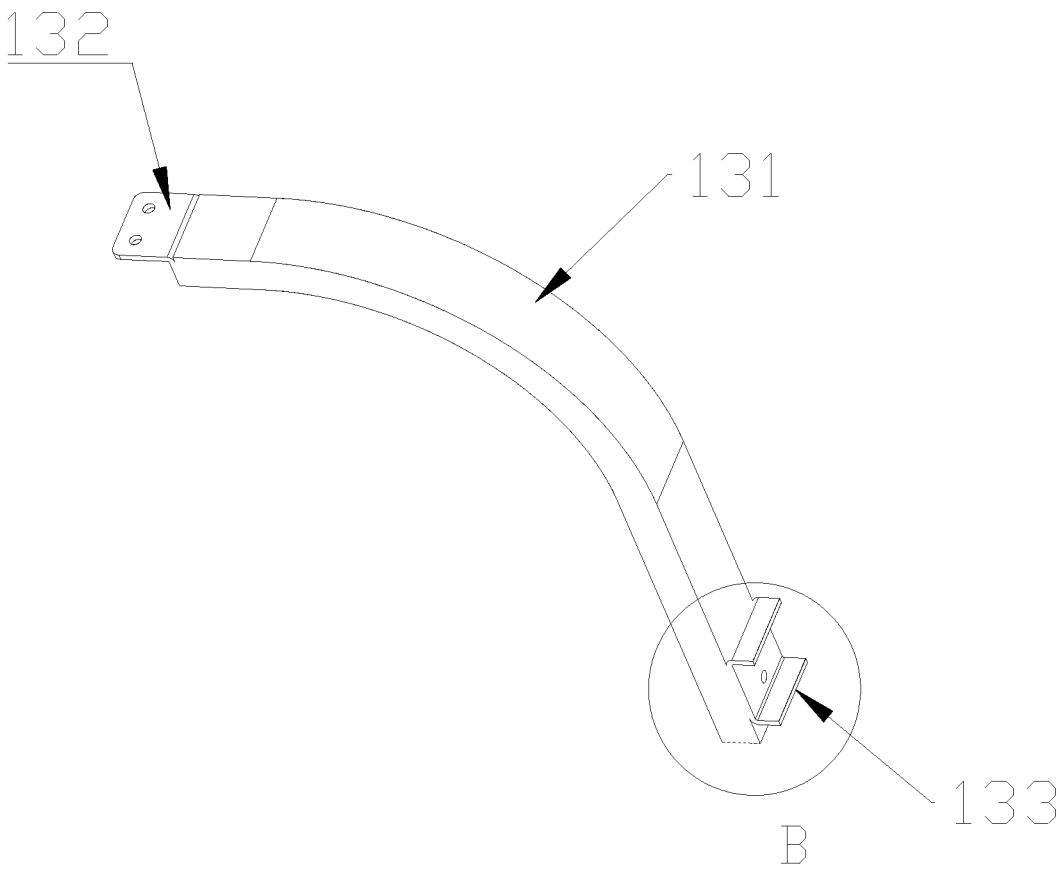
FIG. 7 is a structural schematic diagram of a table board connecting part according to the embodiment of the present patent.
Figure 8:
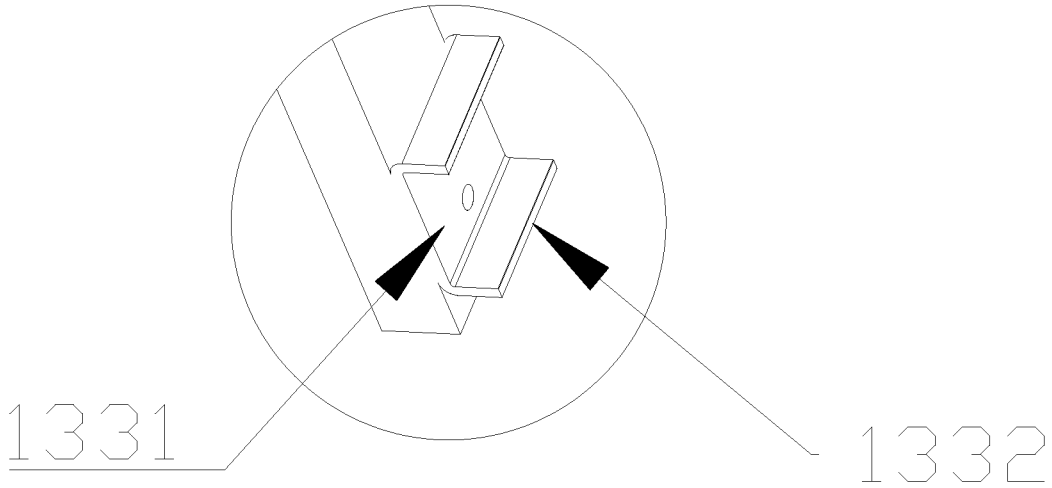
FIG. 8 is an enlarged view of part B in FIG. 7.
Figure 9:
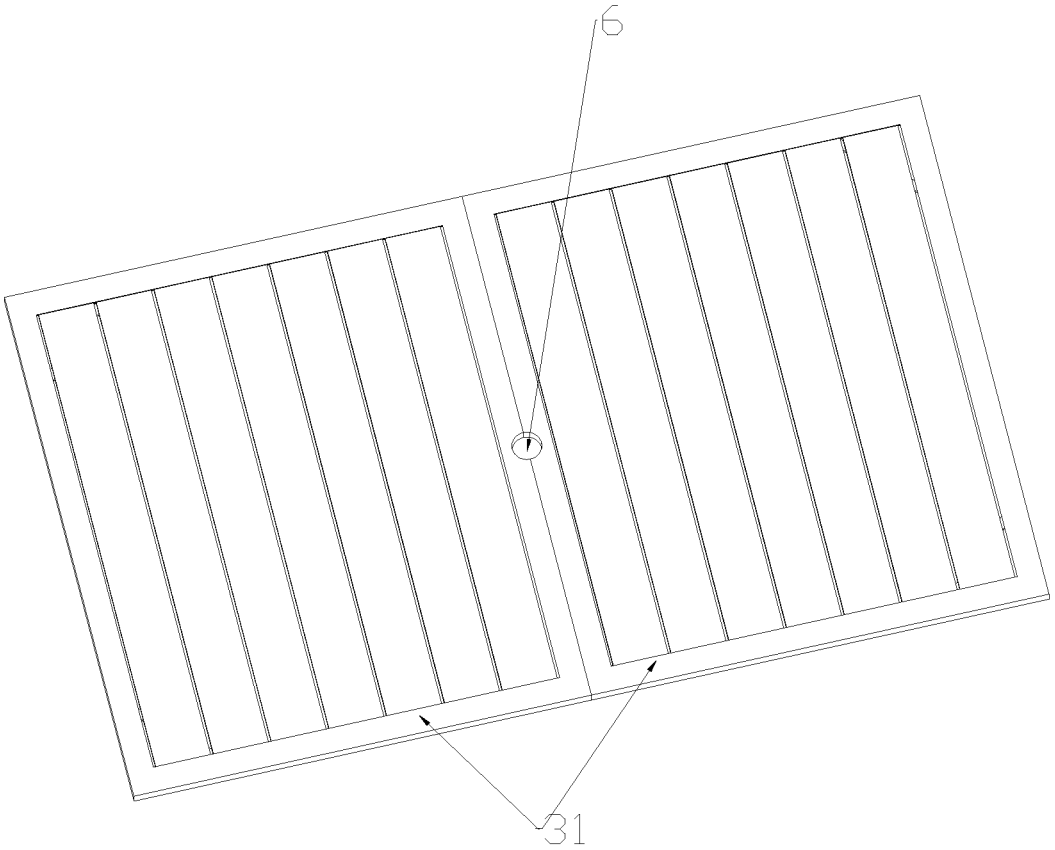
FIG. 9 is a structural schematic diagram of a table board according to the embodiment of the present patent.
Figure 10:
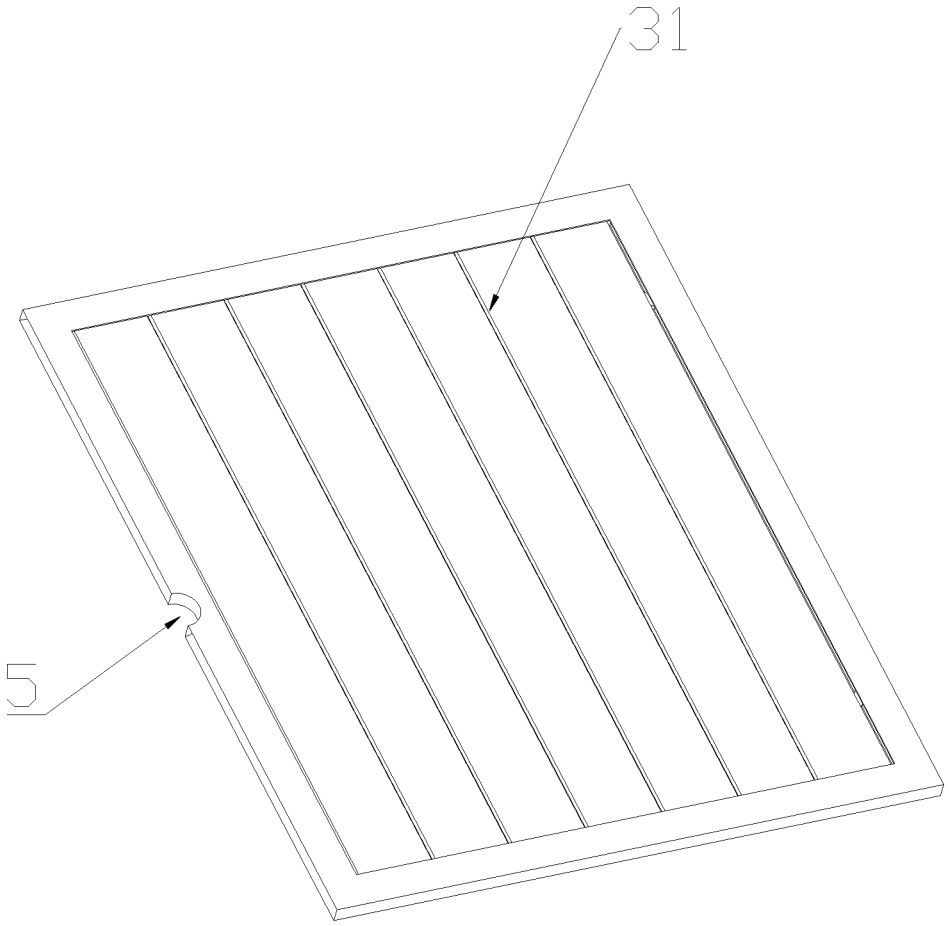
FIG. 10 is a structural schematic diagram of a splicing plate unit according to the embodiment of the present patent.

As shown in FIG. 5, the supporting legs 2 comprise a supporting leg body 21 and a connector 22. The connector 22 is fixed to the top of the supporting leg body 21. The supporting leg connecting part 12 is fixedly connected with the supporting leg body 21. Specifically, the connector 22 is provided with at least two first through holes 221. The fixing part 4 is provided with a second through hole corresponding to the first through hole 221. The supporting legs 2 pass through the first through hole 221 and the second through hole through the first locking member 8 to be detachably connected with the table board 3. In this embodiment, the first locking member 8 can be a bolt. When mounting is required, the supporting legs pass through the first through hole 221 and the corresponding second through hole through the first locking member 8 to connect the supporting legs 2 with the fixing part 4 on the table board 3, so that it is convenient and quick to mount and disassemble.

As an alternative embodiment of this embodiment, the supporting leg body 21 has an arc structure, which can better support the table board 3.

In this embodiment, the supporting leg connecting part 12 comprises a connecting rod 121 and a base body mounting part 122. One end of the connecting rod 121 is fixedly connected with the supporting leg body 21. The end of the connecting rod 121 far away from the supporting leg body 21 is fixedly provided with the base body mounting part 122. The supporting leg connecting part 12 is mounted on the reinforcing base body 11 by the base body mounting part 122. In this embodiment, the base body mounting part 122 is detachably connected with the reinforcing base body 11 by a second locking member 9. The supporting leg connecting part 12 can be disconnected from the reinforcing base body 11 when transferring or transportation is required.

Specifically, in this embodiment, the reinforcing base body 11 has an annular structure. The whole base body mounting part 122 is U-shaped, and comprises a connecting plate 1221 and two clamping plates 1222 which are vertically provided up and down. The connecting rod 121 is fixedly connected with one side of the connecting plate 1221. The two clamping plates 1222 are provided on the other side of the connecting plate 1221 at relative intervals. A clamping position for clamping the reinforcing base body 11 is formed between the two clamping plates 1222 provided on the connecting plate 1221, and the two clamping plates 1222 are capable of being clamped at the upper edge and the lower edge of the reinforcing base body 11. The connecting plate 1221 is fixedly connected with the reinforcing base body 11 placed on the clamping position by the second locking member 9. It should be noted that the second locking member 9 in this embodiment is also a bolt, which is convenient and quick to disassemble.

In this embodiment, the table board connecting part 13 comprises an arc-shaped support rod 131, which can better enhance the strength of the table. Both ends of the arc-shaped support rod 131 are provided with a first connecting end 132 and a second connecting end 133, respectively. The arc-shaped support rod 131 is detachably connected with the table board 3 by the first connecting end 132. Specifically, the first connecting end 132 is a mounting sheet, which is similar to the structure of the connector 22 on the supporting leg 2. The mounting sheet is fixed to the top of the arc-shaped support rod 131. The arc-shaped support rod 131 is detachably connected with the table board 3 by the mounting sheet. The mounting sheet is provided with at least two first through holes. The bottom of the table board 3 is provided with a second through hole corresponding to the first through hole. The arc-shaped support rod 131 passes through the first through hole and the second through hole through a third locking member to be detachably and fixedly connected with the table board 3. In this embodiment, the third locking member can be a bolt. When mounting is required, the arc-shaped support rod passes through the first through hole and the corresponding second through hole through the third locking member to connect the arc-shaped support rod 131 with the table board 3, so that it is convenient and quick to mount and disassemble.

The arc-shaped support rod 131 is mounted on the reinforcing base body 11 by the second connecting end 133, and the second connecting end 133 is detachably connected with the reinforcing base body 11. The structure of the second connecting end 133 in this embodiment is the same as that of the aforementioned base body mounting part 122.

Specifically, the whole second connecting end 133 is also U-shaped, and comprises a vertical plate 1331 and two transverse plates 1332, which are vertically provided up and down, respectively. The arc-shaped support rod is fixedly connected with one side of the vertical plate 1331. The two transverse plates 1332 are provided on the other side of the vertical plate 1331 at relative intervals. A clamping position for clamping the reinforcing base body 11 is formed between the two transverse plates 1332 provided on the vertical plate 1331, and the two transverse plates 1332 are capable of being clamped at the upper edge and the lower edge of the reinforcing base body 11. The vertical plate is fixedly connected with the reinforcing base body 11 placed on the clamping position by the fourth locking member. It should be noted that the fourth locking member in this embodiment is also a bolt, which is convenient and quick to disassemble.

In this embodiment, the reinforcing base body 11 comprises two oppositely provided first reinforcing rods 111 and two oppositely provided second reinforcing rods 112. The first ends of the two first reinforcing rods 111 are fixedly connected by one of the second reinforcing rods 112. The second ends of the two first reinforcing rods 111 are fixedly connected by the other second reinforcing rod 112. The fixed joints of the first reinforcing rods 111 and the second reinforcing rods 112 all transition through circular arcs. The supporting leg connecting part 12 is mounted at the circular-arc fixed joint of the first reinforcing rods 111 and the second reinforcing rods 112 by the corresponding base body installing part 122.

Preferably, in this embodiment, there are two arc-shaped support rods 131. The two arc-shaped support rods 131 are provided opposite to each other, and are both provided at the middle position of the table board 3 along its length direction. The upper ends of the two arc-shaped support rods 131 are fixedly connected with a mounting sheet, respectively, so as to be detachably connected with the table board 3. The lower ends of the two arc-shaped support rods 131 are fixedly connected with a second connecting end 133, respectively, so as to be detachably connected with the first reinforcing rod 111 of the reinforcing base body 11.

In addition, the present patent further provides a splicing table, which comprises a table board 3 and a table board 3 supporting base, wherein the table board 3 supporting base is capable of being detachably fixed to the bottom of the table board 3.

Further, in order to save the packaging volume and the transportation cost during packaging and transportation, in this embodiment, the table board 3 comprises at least two splicing plate units 31. Two adjacent splicing plate units 31 are detachably connected. One surface of the splicing plate units 31 forms the table top of the splicing table. The table board 3 supporting base is detachably provided on the surface of the splicing plate units 31 facing away from the table top. The table board connecting part 13 is provided at the joint of the two splicing plate units 31. Preferably, the mounting sheet is provided with two first through holes. The bottom of each splicing plate unit 31 is provided with a second through hole. The arc-shaped support rod 131 passes through the first through hole and the second through hole through a third locking member to be detachably and fixedly connected with the corresponding splicing plate unit 31.

Specifically, in this embodiment, the table board 3 comprises two splicing plate units 31. The two splicing plate units 31 are capable of being abutted together in opposite directions. The side of one of the splicing plate units 31 is provided with a first semicircular notch, and the side of the other of the splicing plate units 31 is correspondingly provided with a second semicircular notch 5 which is capable of being spliced and matched with the first semicircular notch. The first semicircular notch is spliced and matched with the second semicircular notch 5 to form a circular upper through hole 6. In this embodiment, the table board 3 of the splicing table and the table board 3 supporting base can be made of metal (such as iron). The splicing table can be used outdoors. However, considering the inconvenience caused by the strong sunshine or the influence of rain and snow when used outdoors, the upper through hole 6 is provided. A sunshade or umbrella can be placed in the upper through hole 6 to increase the practicability of the splicing table. The reinforcing base body 11 is further provided with a lower through hole corresponding to the upper through hole 6. When passing through the upper through hole 6, the free end of the rod of the sunshade or umbrella passes into the lower through hole, which further enhances the stability of the sunshade or umbrella mounted on the splicing table and effectively prevents the sunshade or umbrella from tilting. In addition, a plug 7 can be provided at the upper through hole 6. The plug 7 can be mounted in the upper through hole 6 to block the upper through hole 6. The plug 7 can also be taken out from the upper through hole 6 to expose the upper through hole 6 so that a sunshade or umbrella can be put therein. In addition, in order to facilitate the mounting or removal of the plug 7, notches are provided at the periphery of the plug 7.

The splicing table of the present patent can make the table have a smaller volume and a lighter transportation condition in the transportation process, so as to reduce the product packaging cost, and further improve the product packing capacity. It is convenient to mount the table. The product after being assembled has stability which also meets the requirements of customers. At the same time, the table can be effectively prevented from being damaged in the transferring or transportation process.

The above are only the specific embodiments of the present patent, but the scope of protection of the present patent is not limited thereto. Any changes or substitutions conceivable to those skilled in the art within the technical scope disclosed in the present patent should be covered by the scope of protection of the present patent. Therefore, the scope of protection of the present patent shall be subject to the scope of protection of the claims.

What is claimed is:

1. A detachable table board supporting base, comprising a base body and a base reinforcing mechanism, wherein the base body is detachably provided below the table board, wherein:

the base body comprises supporting legs provided at the bottom of the table board, the table board is detachably connected above the supporting legs, and the supporting legs are used to support the table board;

the base reinforcing mechanism comprises a reinforcing base body, a supporting leg connecting part and a table board connecting part, one end of the supporting leg connecting part is detachably connected with the reinforcing base body, the other end of the supporting leg connecting part is fixedly connected with the corresponding supporting leg, and the table board connecting part is detachably connected between the reinforcing base body and the table board;

wherein the table board connecting part comprises an arc-shaped support rod, both ends of the arc-shaped support rod are provided with a first connecting end and a second connecting end, respectively, the arc-shaped support rod is detachably connected with the table board by the first connecting end, the arc-shaped support rod is mounted on the reinforcing base body by the second connecting end, and the second connecting end is detachably connected with the reinforcing base body.

2. The detachable table board supporting base according to claim 1, wherein there are four supporting legs which are provided at the bottom of the table board in a square matrix, the bottom surface of the table board is provided with fixing parts, the number of the fixing parts is the same as that of the supporting legs, the positions of the fixing parts correspond to the positions of the supporting legs, and the tops of the supporting legs are capable of being locked to the corresponding fixing parts by a first locking member.

3. The detachable table board supporting base according to claim 2, wherein the supporting legs comprise a supporting leg body and a connector, the connector is fixed to the top of the supporting leg body, and the supporting leg connecting part is fixedly connected with the supporting leg body.

4. The detachable table board supporting base according to claim 3, wherein the supporting leg body has an arc structure, and the reinforcing base body has an annular structure.

5. The detachable table board supporting base according to claim 3, wherein the supporting leg connecting part comprises a connecting rod and a base body mounting part, one end of the connecting rod is fixedly connected with the supporting leg body, the end of the connecting rod far away from the supporting leg body is fixedly provided with the base body mounting part, the supporting leg connecting part is mounted on the reinforcing base body by the base body mounting part, and the base body mounting part is detachably connected with the reinforcing base body by a second locking member.

6. The detachable table board supporting base according to claim 5, wherein the whole base body mounting part is U-shaped, and comprises a connecting plate and two clamping plates, the connecting rod is fixedly connected with one side of the connecting plate, the two clamping plates are provided on the other side of the connecting plate at relative intervals, a clamping position for clamping the reinforcing base body is formed between the two clamping plates, and the two clamping plates are capable of being clamped at the upper edge and the lower edge of the reinforcing base body, and the connecting plate is fixedly connected with the reinforcing base body placed on the clamping position by the second locking member.

7. The detachable table board supporting base according to claim 5, wherein the reinforcing base body comprises two oppositely provided first reinforcing rods and two oppositely provided second reinforcing rods, the first ends of the two first reinforcing rods are connected by one of the second reinforcing rods, the second ends of the two first reinforcing rods are connected by the other second reinforcing rod, fixed joints of the first reinforcing rods and the second reinforcing rods all transition through circular arcs, and the supporting leg connecting part is mounted at a circular-arc fixed joint of the first reinforcing rods and the second reinforcing rods by the corresponding base body installing part.

8. A splicing table, comprising a table board and a table board supporting base, wherein the table board supporting base is the detachable table board supporting base according to claim 1, and the table board supporting base is capable of being detachably fixed to the bottom of the table board;

the table board comprises at least two splicing plate units, two adjacent splicing plate units are detachably connected, one surface of the splicing plate units forms the table top of the splicing table, the table board supporting base is detachably provided on the surface of the splicing plate units facing away from the table top, the table board connecting part is provided at the joint of the two splicing plate units, and the two splicing plate units are both detachably connected with the table board connecting part.

9. The splicing table according to claim 8, wherein the table board comprises two splicing plate units, the two splicing plate units are capable of being abutted together in opposite directions, the side of one of the splicing plate units is provided with a first semicircular notch, the side of the other of the splicing plate units is correspondingly provided with a second semicircular notch which is capable of being spliced and matched with the first semicircular notch, and the first semicircular notch is spliced and matched with the second semicircular notch to form a circular upper through hole.

* * * * *